United States Patent [19]

Burchart

[11] 4,106,500

[45] Aug. 15, 1978

[54] MASSAGING APPARATUS

[76] Inventor: Samuel C. Burchart, 822 W. 46th St., Richmond, Va. 23225

[21] Appl. No.: 787,689

[22] Filed: Apr. 14, 1977

[51] Int. Cl.[2] ..... A61H 1/00

[52] U.S. Cl. ..... 128/36

[58] Field of Search ..... 128/33–36, 128/41, 46, 24.1, 24.2, 32

[56] References Cited

U.S. PATENT DOCUMENTS

| | | | |
|---|---|---|---|
| 2,113,444 | 4/1938 | Erickson | 128/36 |
| 2,347,554 | 4/1944 | Gothers | 128/36 |
| 2,742,036 | 4/1956 | Montesano | 128/36 |
| 3,457,911 | 7/1969 | Carpenter | 128/24.2 |
| 3,841,320 | 10/1974 | Brown | 128/33 |
| 3,896,795 | 7/1975 | Solhkhah | 128/32 |

*Primary Examiner*—Lawrence W. Trapp
*Attorney, Agent, or Firm*—Norman B. Rainer

[57] ABSTRACT

An apparatus is provided for attachment to a hand held type of orbital vibrator. The apparatus affords more convenient manipulation by the user and distributes the vibratory effect for massaging purposes over a greater area of application.

6 Claims, 3 Drawing Figures

MASSAGING APPARATUS

BACKGROUND OF THE INVENTION

This invention relates to an improvement concerning the use of an orbital type of hand-held vibrator, and more particularly to an attachment for such vibrator which produces a more widespread distribution of the vibratory effect, permitting more versatile utilization of the vibrator.

Various devices have been disclosed for use with therapuetic vibrators with the intention of modifying their mode of utilization in producing massaging effects on the human body.

For example, U.S. Pat. No. 3,057,348 discloses the mounting of an orbital type vibrator on a board containing suction cups on its underside to enable attachment at the location where massage action is desired.

U.S. Pat. No. 3,710,784 discloses the riveting of a vibrator to a flat board containing a heating pad on its underside.

U.S. Pat. No. 3,094,982 concerns a vibrator that emits a linear back-and-forth type of vibration which is transmitted through a single stem. Said vibrator is mounted onto a base plate, and different attachments are affixed to the stem for massaging the user's feet or back. The foot massaging attachment is applicable to only one foot at a time.

U.S. Pat. No. 3,364,921 discloses the mounting of a vibrator designed for single hand manipulation onto a flat plate equipped with an elongated handle to enable the user to massage portions of his body beyond the reach of his hands. The vibrator, having a head that emits a linear type of vibration, is utilized in a manner such that the head itself is brought directly into contact with the user's body.

Vibrating devices designed to be held in one hand during use for massaging purposes cannot be effectively used by an individual to reach all parts of his own body, especially regions of the upper and middle back. A particularly desirable type of said vibrating device utilizes a principle involving an off-centered rotational effect of an elongated body, such as the rotor core of an electric motor, rapidly spinning about its axis. The off-centered rotation is produced by either a deliberate mis-alignment of the axis of the elongated body in retaining bearings at each of its extremities, or uneven distribution of weight about the axis of rotation. The vibration, having an essentially eliptical orbit of movement in a plane perpendicular to the spinning core, is transmitted to a base plate via spaced standards which support the retaining bearings in opposed spaced relationship over said base plate. Vibrators of this type are preferred for massaging purposes and are referred to herein as orbital vibrators.

Although considerable prior effort has been directed toward enabling users of vibrators to administer self massage to their upper and middle backs, these efforts have not been successful. For example, the simple expedient of mounting the vibrator in association with a long handle may permit the user to reach otherwise inaccessible regions of his body. However, the weight of the assembly, the inability to hold it tightly against the body in certain positions, and the awkward hand positions required for holding the assembly have rendered prior expedients ineffective.

It is accordingly an object of the present invention to provide an apparatus for releasable attachment to a hand operable vibrator whereby the vibratory action generated by said vibrator may be transmitted for massage purposes to parts of the body of the user inaccessible without said apparatus. It is another object to provide detachable mounting apparatus to accommodate a hand manipulated orbital vibrator whereby the vibratory action generated by said vibrator may be distributed for massage purposes to a larger area of the body than can be achieved without said apparatus. It is a still further object to provide detachable mounting apparatus to accommodate a conventional hand operable vibrator, said apparatus being adapted to grasping and manipulation by both hands of the user and capable of providing massaging vibrations to both his feet simultaneously. Other objects and advantages will become apparent hereinafter.

SUMMARY OF THE INVENTION

The objects of the present invention are accomplished in general by providing an apparatus comprising an elongated flat rigid platform, the upper and lower surfaces of which contain resilient cushioning material, said upper surface containing centrally positioned mounting means for a hand held type vibrator, and foot engaging means located near each extremity of said apparatus. The elongated flat rigid base is preferably symmetrically shaped with respect to its longitudinal and lateral axes, the width of said base tapering from a wide region at said lateral axis to a narrow region at each extremity.

BRIEF DESCRIPTION OF THE DRAWING

In the accompanying drawing forming a part of this specification and in which similar numerals of reference indicate corresponding parts in all the figures of the drawing.

DETAILED DESCRIPTION OF THE INVENTION

Figure 2:
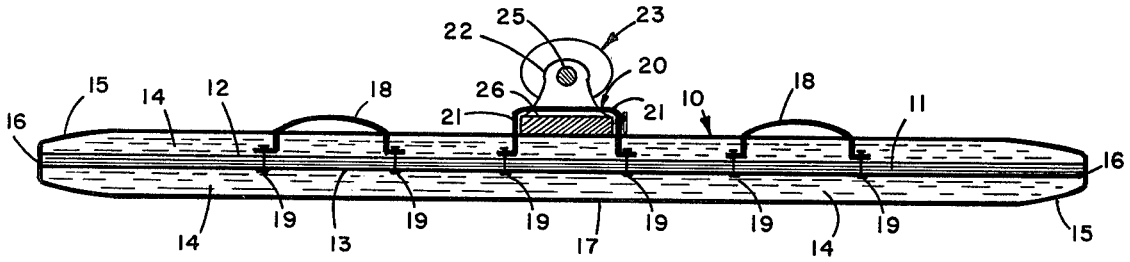
FIG. 2 is a transverse sectional view taken along the line 2—2 of FIG. 1.
Figure 3:
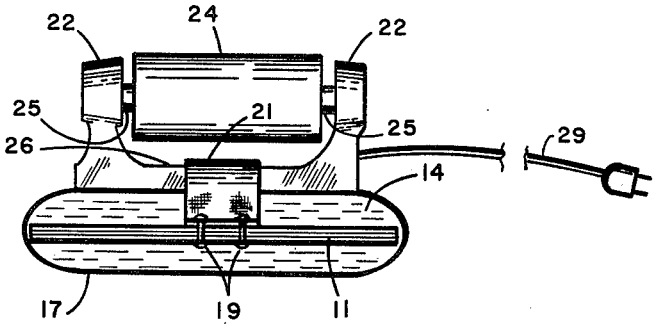
FIG. 3 is a transverse sectional view taken along the line 3—3 of FIG. 1.

Referring to FIG. 2, base assembly 10 is shown consisting of flat rigid platform 11 containing on both upper surface 12 and lower surface 13 resilient cushioning material 14 having uniform thickness except for a slight tapering 15 near each end 16 of said base assembly. A cover member 17 comprised of thin flexible sheet material completely envelopes base assembly 10. Identical holding members 18 disposed at each end of base assembly 10 and protruding above the upper surface thereof, are fastened by anchoring means 19 to platform 11. A vibrator harness, represented by strap and buckle assembly 20, having strap members 21 and buckle 28 is centrally positioned on the upper surface of base assembly 10. The lower extremities of strap members 21 are attached to platform 11 by anchoring means 19.

Figure 1:
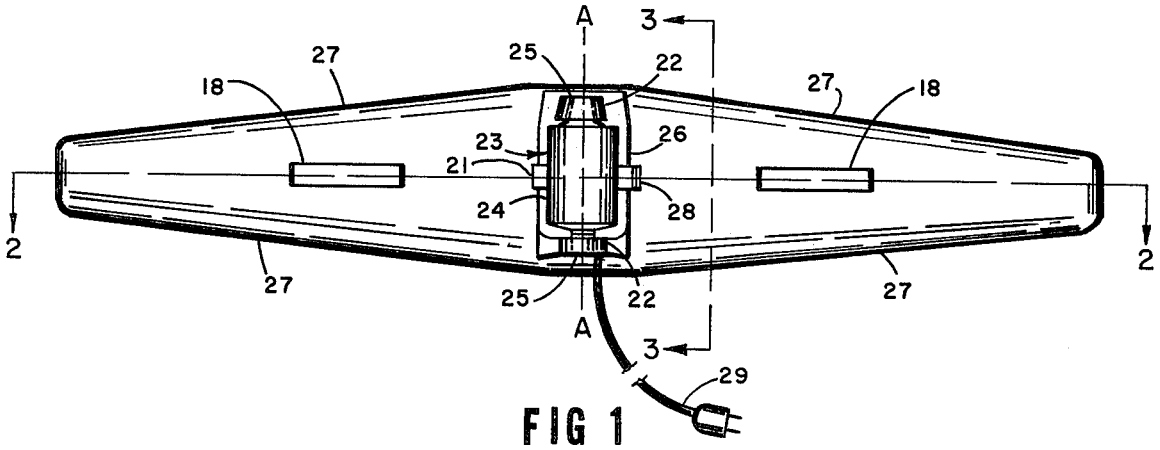
FIG. 1 is a top plan view of an embodiment of the apparatus of this invention in engagement with an orbital vibrator.

Although the base assembly illustrated in the drawing is bounded by six straight edges, it is to be understood that differently shaped base assemblies are contemplated as being within the purview of this invention. The shape of the base assembly is, however, characterized in possessing symmetry about its longitudinal axis, line 2—2 of FIG. 1, and symmetry about its lateral axis which may be defined as the perpendicular bisector of said longitudinal axis and represented as line A—A in FIG. 1. The base assembly is wider in the region of its lateral axis than at its ends, the width at said lateral axis being between about 5 and 12 inches.

The sides 27 of base assembly 10 converge as straight or curved lines to end portions 16 spaced between about 24 to 40 inches apart and having a width, measured in the direction parallel to lateral axis A—A, of between about 2 and 4 inches. The combined width of end portions 16, and the thickness of the base assembly at said end portions is such as to permit comfortable gripping of the base member with one hand.

An orbital vibrator 23 is shown consisting of electrical motor 24 having a rotating shaft 25 journaled within bearing mounts 22 which support the motor above base plate 26. The vibrator 23 is positioned on the upper surface of said base assembly in a manner such that the axis of rotating shaft 25, and lateral axis A—A, are essentially parallel and lie in substantially the same vertical plane. The orbit of rotation of said shaft is therefore in a plane perpendicular to said base assembly and parallel to its longitudinal axis.

Holding members 18 are substantially loops aligned with the longitudinal axis of the base assembly, and adapted to accommodate the feet of the user. Each loop is provided with means for size adjustment. The loops may consist of either belt and buckle combinations, or belt members tensioned by springs, rubber straps, or other resilient means. The two bottom ends of each loop are anchored to platform 11 by conventional anchoring means such as bolts, clamps, rivets, staples, adhesives, knotting, and the like. The holding members are positioned equidistantly from lateral axis A—A and within about 5 inches of the respective ends 16 of the base assembly.

The vibrator harness means 20 preferably consists of at least one adjustable loop structure aligned with the longitudinal axis of the base assembly and centered on or near lateral axis A—A. In some embodiments, two adjustable loop structures may be utilized in parallel juxtaposition. The harness means may consist of positively locking contrivances such as a belt and buckle combination, or belt members tensioned by springs or comprised of resilient straps. The harness means is adapted to grip the base plate of the vibrator essentially mid-way between bearing mounts 22 in a manner such that strap member 21 is disposed perpendicularly to rotating shaft 25. The function of the harness means is to secure the vibrator tightly to the upper surface of the apparatus, while facilitating easy release thereof when such is desired by the user. The lower extremities of strap members 21 are anchored to platform 11 by conventional fastening means such as those which may be utilized with the aforementioned holding members 18.

The mode of mounting of the vibrator unit onto the base assembly is such that the eliptical motion of the vibrator is in a plane parallel to the longitudinal axis and perpendicular to the lateral axis of said base assembly. In this manner of mounting there appears to be efficient transfer of the vibratory energy from the vibrator to the base assembly, causing the base assembly to function as a resonating means for distributing the vibrations over a relatively large area. Mounting of the vibrator in a manner whereby its eliptical motion is in a plane perpendicular to the longitudinal axis would not achieve the desired resonant coupling with the base assembly. Another advantage of the manner in which the vibrator is mounted is that the electrical cord 29 is thereby located so as to cause minimal interference during use of the assembly.

The rigid platform 11 may consist of reasonably lightweight material of suitable stiffness to resist deformation of the base assembly with the vibrator unit mounted thereon. Exemplary materials include plywood of $\frac{1}{4}$-inch or $\frac{3}{8}$-inch thickness, magnesium or aluminum sheet, and plastic sheets, particularly those containing fibrous reinforcement.

The resilient cushioning material 14 is applied in a uniform thickness of between about $\frac{1}{4}$ inch and 1 inch on both surfaces of said rigid platform and preferably envelopes the entire platform. Suitable resilient cushioning materials include foamed polymers such as polyethylene, polyvinylchloride, polyurethane, and natural or synthetic rubbers. The foamed configuration of said polymers provides light weight and a comfortable softness which enables the base assembly to conform to certain contours and configurations of the user's body. Non-foam forms of resilient polymers would not provide adequate softness. Foamed or other low bulk density or easily deformable forms of non-resilient polymer or fiber would not provide the desired resonant effect, and in fact could exert an opposite, or damping effect. Cushioning material 14 must therefore be resilient, easily deformable, and of low bulk density to achieve its intended purpose in the apparatus of this invention.

The cover member 17 is comprised of thin, durable and flexible sheet material such as fabric, films, leather, and laminated materials. The cover member may consist of a single integral piece of material which is suitably seamed or otherwise unified at the edges of the base member.

Because of the special design of the apparatus of this invention, a person can utilize a hand-held orbital vibrator to apply massaging action to regions of his or her body otherwise inaccessible by self use of said vibrator. The apparatus is particularly effective in the massaging of one's back because the apparatus can be held by both hands to apply leverage for imparting pressure against the body. Such leverage and resultant pressure against the user's back cannot be produced with devices of the prior art which merely mount a vibrator on an extension handle.

While particular examples of the present invention have been shown and described, it is apparent that changes and modifications may be made herein without departing from the invention in its broadest aspects. The aim of the appended claims, therefore, is to cover all such changes and modifications as fall within the true spirit and scope of the invention.

Having thus described my invention, what is claimed is:

1. An apparatus for use in combination with an orbital vibrator comprising a base assembly comprised of an elongated flat rigid platform symmetrically shaped with respect to its longitudinal and lateral axes and tapering from a wide region at said lateral axis to a narrow region at each longitudinal extremity, and resilient cushioning material of uniform thickness evenly disposed on the upper and lower surfaces of said platform, a pair of holding members anchored in said platform and extending above said cushioning material above the upper surface of said platform and equidistantly spaced from said lateral axis, and harness means located above said cushioning material above the upper surface of said platform and substantially centered on said lateral axis, said harness means being anchored in said platform and adapted to secure an orbital vibrator tightly against said base assembly.

2. The apparatus of claim 1 wherein said orbital vibrator possesses a rotating shaft and is held by said harness means in a manner such that the axis of said rotating shaft and the lateral axis of said platform are essentially parallel and lie in substantially the same plane vertical to said platform.

3. The apparatus of claim 1 wherein said cushioning material envelopes the entire platform.

4. The apparatus of claim 1 wherein said holding members and harness means are configured as loops aligned with said longitudinal axis.

5. The apparatus of claim 1 wherein said cushioning material is covered throughout said apparatus with a thin flexible sheet material.

6. The apparatus of claim 1 wherein said cushioning material is a foamed resilient material.

* * * * *